US009365315B2

(12) United States Patent
Kim et al.

(10) Patent No.: US 9,365,315 B2
(45) Date of Patent: Jun. 14, 2016

(54) VERSATILE LIGHTING SYSTEM FOR DISPENSING CABINETS

(71) Applicant: Omnicell, Inc., Mountain View, CA (US)

(72) Inventors: Stanley Kim, Mountain View, CA (US); Daniel Steinberger, Mountain View, CA (US); Mimosa Le, Mountain View, CA (US); Gerardo Moreno, Mountain View, CA (US); Robert J. Young, Mountain View, CA (US)

(73) Assignee: OMNICELL, INC., Mountain View, CA (US)

( * ) Notice: Subject to any disclaimer, the term of this patent is extended or adjusted under 35 U.S.C. 154(b) by 104 days.

(21) Appl. No.: 14/166,403

(22) Filed: Jan. 28, 2014

(65) Prior Publication Data

US 2015/0209237 A1 Jul. 30, 2015

(51) Int. Cl.

| | |
|---|---|
| ***A61J 7/04*** | (2006.01) |
| ***B65D 25/04*** | (2006.01) |
| ***G07F 17/00*** | (2006.01) |
| ***A61J 7/00*** | (2006.01) |
| *F21V 33/00* | (2006.01) |
| *F21V 23/00* | (2015.01) |
| *F21Y 101/02* | (2006.01) |

(52) U.S. Cl.

CPC ..... *B65D 25/04* (2013.01); *A61J 7/0084* (2013.01); *G07F 17/0092* (2013.01); *A61J 2205/20* (2013.01); *F21V 23/003* (2013.01); *F21V 33/0068* (2013.01); *F21Y 2101/02* (2013.01)

(58) Field of Classification Search

CPC ..... G07F 17/0092

USPC ..... 700/237, 240, 242

See application file for complete search history.

(56) References Cited

U.S. PATENT DOCUMENTS

| | | | |
|---|---|---|---|
| 5,190,185 | A | 3/1993 | Blechl |
| 5,377,864 | A | 1/1995 | Blechl et al. |
| 5,745,366 | A | 4/1998 | Higham et al. |

(Continued)

OTHER PUBLICATIONS

Author Unknown, "Pharmacy Drawer Options", Omnicell, Inc., http://www.mts-mt.com/Products_and_Solutions_For_Pharmacy/~/media/MTS/Flies/Products/AccessSolutions/Pharmacy_Drawer_Options_Datasheet.ashx, retrieved on Dec. 26, 2013, 2 pages.

(Continued)

*Primary Examiner* — Timothy Waggoner

(74) *Attorney, Agent, or Firm* — Kilpatrick Townsend & Stockton LLP

(57) ABSTRACT

In one implementation, a device for dispensing items includes a plurality of compartments for storing medicines or medical supplies, a respective light source associated with each of the plurality of compartments, and a computerized controller coupled to the light sources. The computerized controller maintains an inventory of the contents of the plurality of compartments and receives requests to dispense medicines or medical supplies from the plurality of compartments. In response to a request to dispense a particular medicine or medical supply item, the computerized controller illuminates the light source associated with the compartment holding the particular medicine or medical supply item, the light source being illuminated with a brightness controlled by the computerized controller. The brightness of the light source may be controlled in accordance with a detected brightness of the ambient environment. The light source may be a multi-colored light source.

23 Claims, 7 Drawing Sheets

(56) References Cited

U.S. PATENT DOCUMENTS

| | | | | |
|---|---|---|---|---|
| 5,805,455 | A | 9/1998 | Lipps | |
| 5,805,456 | A | 9/1998 | Higham et al. | |
| 5,905,653 | A | 5/1999 | Higham et al. | |
| 5,927,540 | A | 7/1999 | Godlewski | |
| 5,971,594 | A | 10/1999 | Sahai et al. | |
| 6,011,999 | A | 1/2000 | Holmes | |
| 6,039,467 | A | 3/2000 | Holmes | |
| 6,151,536 | A | 11/2000 | Arnold et al. | |
| 6,170,929 | B1 | 1/2001 | Wilson et al. | |
| 6,272,394 | B1 | 8/2001 | Lipps | |
| 6,385,505 | B1 | 5/2002 | Lipps | |
| 6,609,047 | B1 | 8/2003 | Lipps | |
| 6,636,780 | B1 * | 10/2003 | Haitin et al. | 700/236 |
| 6,640,159 | B2 | 10/2003 | Holmes et al. | |
| 6,650,225 | B2 * | 11/2003 | Bastian et al. | 340/5.92 |
| 6,760,643 | B2 | 7/2004 | Lipps | |
| 6,775,588 | B1 * | 8/2004 | Peck | 700/214 |
| 6,975,922 | B2 | 12/2005 | Duncan et al. | |
| 7,348,884 | B2 | 3/2008 | Higham | |
| 7,440,818 | B2 * | 10/2008 | Handfield et al. | 700/240 |
| 7,571,024 | B2 | 8/2009 | Duncan et al. | |
| 7,675,421 | B2 | 3/2010 | Higham | |
| 7,835,819 | B2 | 11/2010 | Duncan et al. | |
| 8,126,590 | B2 | 2/2012 | Vahlberg et al. | |
| 8,165,929 | B2 * | 4/2012 | Chudy et al. | 705/28 |
| 8,280,550 | B2 | 10/2012 | Levy et al. | |
| 8,610,574 | B2 * | 12/2013 | Kestenbaum | 340/572.1 |
| 8,643,481 | B2 * | 2/2014 | Campbell et al. | 340/438 |
| 8,924,227 | B2 * | 12/2014 | Fellows et al. | 705/2 |
| 9,002,510 | B2 * | 4/2015 | Chudy et al. | 700/242 |
| 2006/0088196 | A1 | 4/2006 | Popovich et al. | |
| 2008/0203107 | A1 | 8/2008 | Conley et al. | |
| 2009/0134181 | A1 | 5/2009 | Wachman et al. | |
| 2012/0203377 | A1 | 8/2012 | Paydar et al. | |

OTHER PUBLICATIONS

International Search Report and Written Opinion of related PCT/US2015/012994 mailed on Apr. 17, 2015, 16 pages.

* cited by examiner

VERSATILE LIGHTING SYSTEM FOR DISPENSING CABINETS

BACKGROUND OF THE INVENTION

In a hospital or other patient care setting, a large number of medications and other medical supplies may be used. Different patients typically require different medications, and different medications may be subject to different legal standards for access and control. It is highly desirable that medications and supplies be tracked and access to them be controlled, to avoid medication errors, to avoid illicit access, and to facilitate inventory control and accounting functions.

BRIEF SUMMARY OF THE INVENTION

According to one aspect, a device for dispensing items comprises a plurality of compartments for storing medicines or medical supplies, a respective light source associated with each of the plurality of compartments, and a computerized controller coupled to the light sources. The computerized controller is capable of controlling the light sources, and the computerized controller maintains an inventory of the contents of the plurality of compartments and receives requests to dispense medicines or medical supplies from the plurality of compartments. In response to a request to dispense a particular medicine or medical supply item, the computerized controller illuminates the light source associated with the compartment holding the particular medicine or medical supply item, the light source being illuminated with a brightness controlled by the computerized controller. In some embodiments, the computerized controller selects the brightness of the light source in response to an input from a user of the device. In some embodiments, the device further comprises a sensor that detects the brightness of the ambient environment, and the computerized controller automatically selects the brightness of the light source in response to the detected brightness of the ambient environment. In some embodiments, the light sources are multi-colored light sources configured to emit light of a first color at a first time and light of a second color at a second time, and the color of light emitted by the multi-colored light sources is controlled by the computerized controller. In some embodiments, the computerized controller illuminates the multi-colored light source associated with the compartment holding the particular medicine or medical supply item such that the color of light emitted by the illuminated multi-colored light source conveys information about the type of the particular medicine or medical supply item in the associated compartment. The computerized controller may cause at least one of the plurality of light sources to flash in order to communicate information to a user of the device. The computerized controller may cause at least one of the plurality of light sources to be illuminated using a particular color and a particular flash pattern in order to communicate information to a user of the device.

According to another aspect, a device for dispensing items comprises a plurality of compartments for storing items, a respective multi-colored light source associated with each of the plurality of compartments, and a computerized controller coupled to the multi-colored light sources, the computerized controller controlling one or more of the multi-colored light sources to emit light of a first color at a first time and light of a second color at a second time. In some embodiments, the plurality of multi-colored light sources comprises one or more multi-colored light emitting diodes. In some embodiments, one of the plurality of multi-colored light sources comprises a first light emitting diode that emits light of the first color, and a second light emitting diode that emits light of the second color, the first and second light emitting diodes being in separate packages. In some embodiments, the compartments store medicines or medical supplies, the computerized controller maintains an inventory of the contents of the plurality of compartments and receives requests to dispense medicines or medical supplies from the plurality of compartments, and in response to a request to dispense a particular medicine or medical supply item, the computerized controller illuminates the multi-colored light source associated with the compartment holding the particular medicine or medical supply item such that the color of light emitted by the illuminated multi-colored light source conveys information about the type of the particular medicine or medical supply item in the associated compartment. The color of light emitted by the illuminated multi-colored light source may be selected based at least in part on the controlled substance schedule of a particular medicine in the associated compartment. The computerized controller may cause one or more of the multi-colored light sources to flash in a particular pattern to communicate information to a user of the device. In some embodiments, the particular pattern identifies a fault condition of the device. In some embodiments, the combination of the color of light emitted by the flashing multi-colored light source and the particular pattern identifies a fault condition of the device. In some embodiments, the computerized controller is configured to detect a state of each of the plurality of compartments, and the computerized controller controls one or more of the multi-colored light sources to indicate the state of one or more of the compartments. In some embodiments, the computerized controller controls one or more of the plurality of multi-colored light sources to indicate that the one of the plurality of compartments is overfilled. In some embodiments, the computerized controller controls one or more of the plurality of multi-colored light sources to indicate that one of the plurality of compartments has been the subject of a break-in attempt. The computerized controller may control one or more of the plurality of multi-colored light sources to indicate that one of the plurality of associated compartments has been opened in error. The brightness of the multi-colored light sources may be adjustable under control of the computerized controller. In some embodiments, the computerized controller adjusts the brightness of the multi-colored light sources in response to an input from a user of the device. In some embodiments, the device for dispensing items further comprises a sensor that detects the brightness of the ambient environment, and the computerized controller automatically adjusts the brightness of the multi-colored light sources in response to the detected brightness of the ambient environment. In some embodiments, the computerized controller maintains an inventory of the contents of the plurality of compartments and receives requests to dispense items from the plurality of compartments, and in response to a request to dispense a particular item, the computerized controller causes the multi-colored light source associated with the compartment holding the particular item to emit light of a first color, and causes the multi-colored light sources associated with other compartments to emit light of a second color different from the first color. In some embodiments, the computerized controller maintains an inventory of the contents of the plurality of compartments and receives requests to dispense items from the plurality of compartments, and in response to a request to dispense a particular item, the computerized controller causes the multi-colored light source associated with the compartment holding the particular item to emit light of a color selected based upon whether a user of the device is authorized to access the particular item.

DETAILED DESCRIPTION OF THE INVENTION

Figure 1:
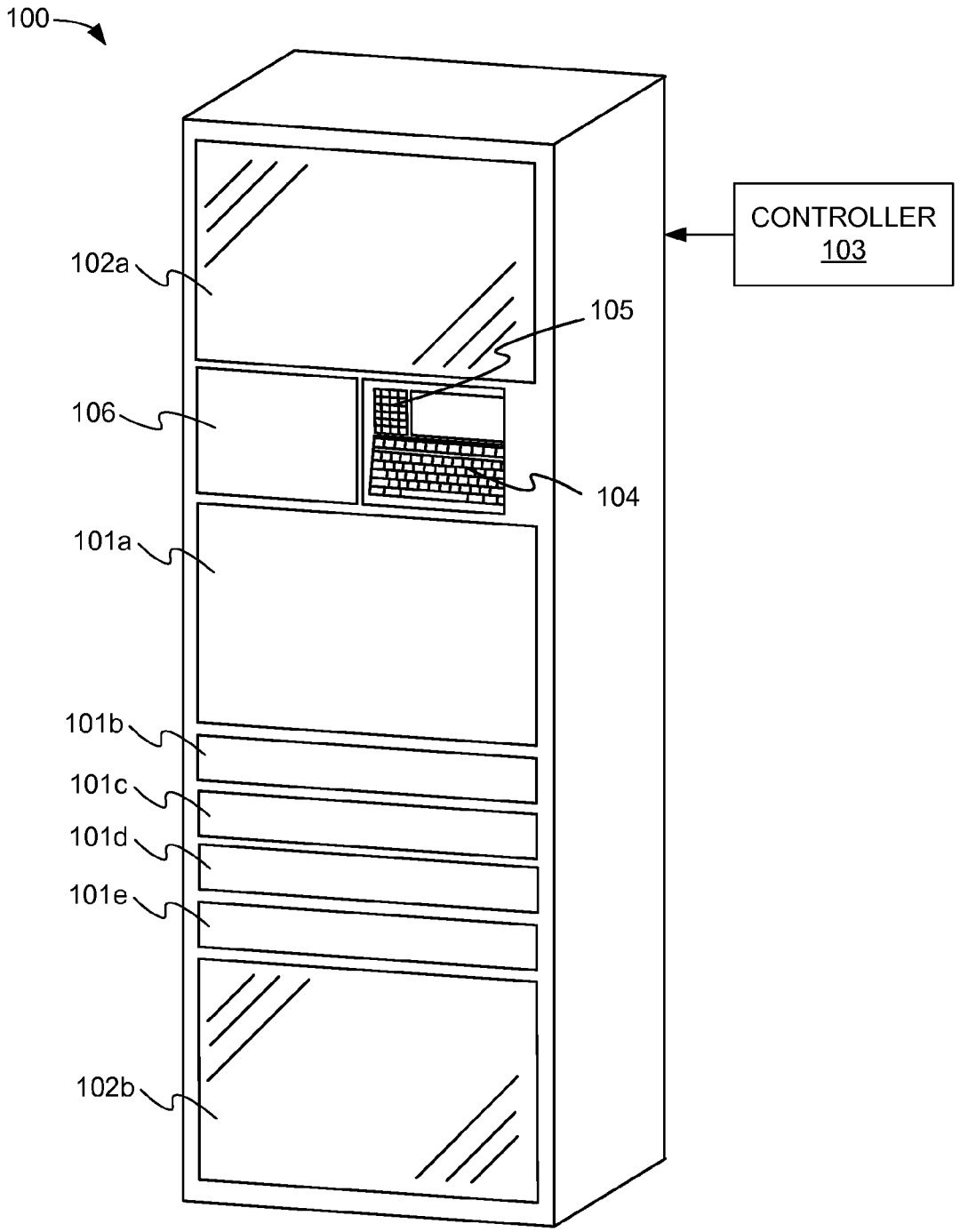
FIG. 1 illustrates a dispensing cabinet in which the invention may be embodied.

FIG. 1 illustrates a dispensing cabinet 100 in which the invention may be embodied. Cabinet 100 includes a plurality of compartments, including drawers 101*a*-101*e*, and compartments accessible through doors 102*a* and 102*b*. Dispensing cabinet 100 also includes a computerized controller 103, and one or more data entry devices such as keyboard 104 and keypad 105. A display 106 enables communication of information to a user of dispensing cabinet 100. In some embodiments, a dispensing cabinet may include other devices as discussed in more detail below.

While devices embodying the invention may be used in a variety of applications, embodiments may be particularly useful in the medical field. For example, dispensing cabinet 100 may hold medications or medical supplies, and may facilitate the accurate dispensing and tracking of medications or other medical supplies.

Computerized controller 103 may include a processor, memory, input/output interfaces, and other components. Controller 103 may communicate remotely with other computerized systems, such as medical records systems, inventory and accounting systems, and the like.

The various storage compartments such as drawers 101*a*-101*e* may be under the control of controller 103. For example, each of drawers 101*a*-101*e* may include an electronically-controllable locking mechanism, and may only be openable under the control of controller 103. In addition, controller 103 may store information about what supplies are stored in which compartments of medication storage cabinet 100. In one typical basic usage scenario, a health care worker may enter, using keyboard 104 or another input device, an identification of a patient who is under the care of the health care worker, and who will need medication during the worker's current rounds. Controller 103 may access the patient's medical file and determine what medications have been prescribed for that patient. Controller 103 may then permit access only to the drawer or drawers containing the prescribed medications for the patient. A particular compartment such as a bin within the correct drawer may also be highlighted, for example with a lighted indicator, to draw the health care worker to the correct medication. The health care worker can then remove the patient's prescribed medication. The level of control exercised by controller 103 may help in preventing medication and dosing errors, by reducing the likelihood that a health care worker will remove an incorrect medication from medication dispensing cabinet 100. In addition, controller 103 may document and record which medication was dispensed, and may forward that information via a wired or wireless electronic network to inventory and accounting systems.

Many other features and functions are possible as well. For example, the health care worker may enter his or her identification as well, and controller 103 may provide access only to those medications and supplies for which the worker is authorized to access.

While medication dispensing cabinet 100 is shown as a stationary device, the invention is not so limited. Cabinets according to other embodiments may be portable, for example to facilitate transporting medications and supplies from a central supply store to a particular ward or department of a facility. It will be recognized that the particular arrangement of drawers, doors, or other features of a cabinet according to embodiments of the invention may be varied. For example, some cabinets or dispensing carts embodying the invention may use only drawers, only doors, or utilize some other access method. Many different sizes and styles of compartments may be used, depending on the sizes of materials to be dispensed, and the level of security required for them.

Figure 2:
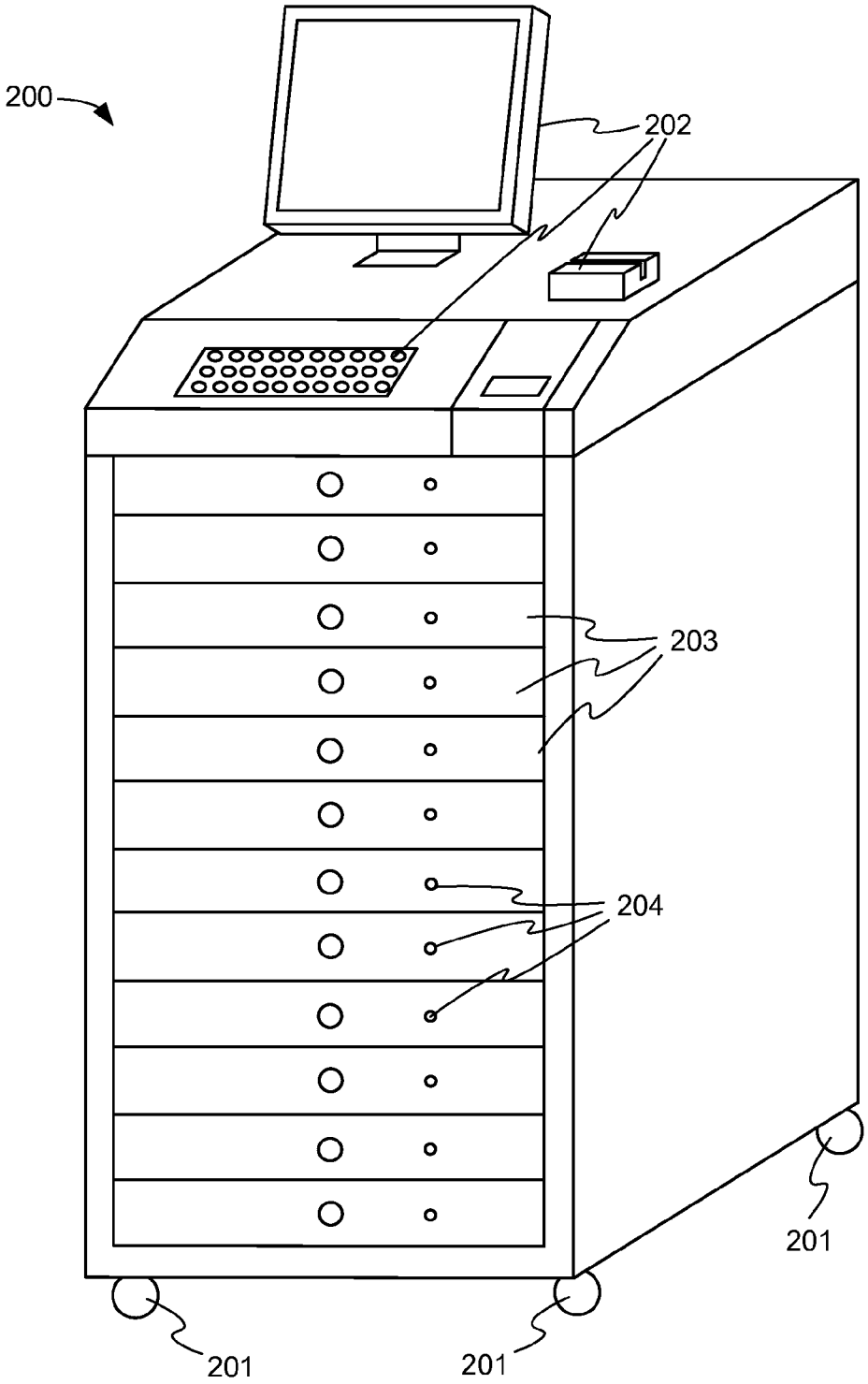
FIG. 2 illustrates a portable dispensing device in which the invention may be embodied.

FIG. 2 illustrates a portable dispensing device 200 in which the invention may be embodied. Preferably, portable dispensing device 200 can perform functions similar to those described above with respect to dispensing cabinet 100. Dispensing device 200 includes wheels 201 to enable a health care worker to wheel the device from room to room. Dispensing device 200 may include one or more batteries, to power a computerized controller that performs tasks similar to controller 103 discussed above, and to provide power for other functions of dispensing device 200. Various input/output devices 202 may be provided, and may be especially adapted for portability, for example to minimize power consumption. Dispensing device 200 also includes a number of drawers 203. Each drawer 203 may include a visual indicator 204 for guiding a user to a particular drawer 203, as is explained in more detail below.

Figure 3:
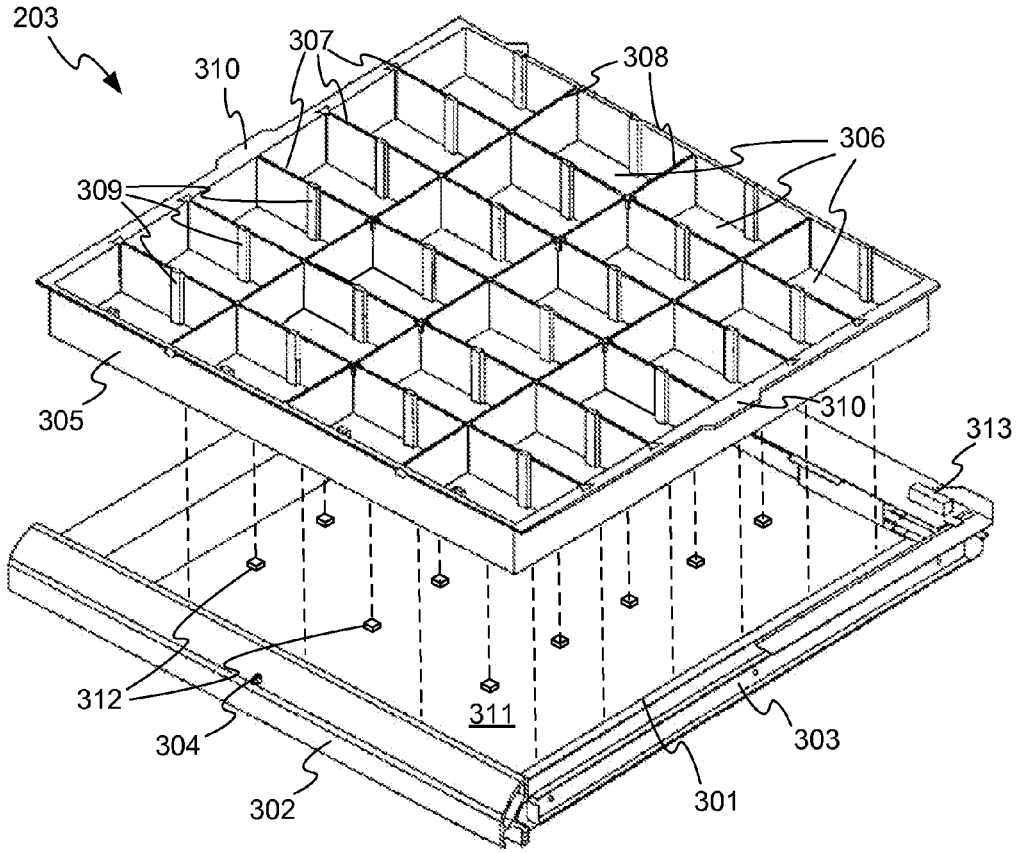
FIG. 3 illustrates an exploded view of a drawer of the dispensing device of FIG. 2 in more detail, according to an example embodiment.

FIG. 3 illustrates an exploded view of one of drawers 203 in more detail, according to an example embodiment. Example drawer 203 comprises a frame 301 having a handle 302 and a track 303 which allows drawer 203 to be slid in and out of dispensing device 200. A visual indicator 304, such as a light emitting diode (LED), is provided on drawer 203 to identify a specific drawer when a specific item is requested to be dispensed. In some embodiments, visual indicator 304 may be a multi-colored light source. Drawer 203 is configured to receive a removable liner 305 which holds the items to be dispensed. Liner 305 may be divided into a plurality of bins 306 by a plurality of adjustable transverse dividers 307 and longitudinal dividers 308. Attached to at least some of the dividers are light pipes 309 which may be employed to guide a caregiver to a specific bin as described in greater detail hereinafter. Liner 305 is configured to conveniently rest within the frame 301 and may be removed by simply lifting liner 305 from drawer 203 by handles 310.

Drawer 203 comprises a printed circuit board 311 on which are mounted a plurality of multi-colored light sources 312. A multi-colored light source is one that can emit light of a first color at a first time, and light of a second color at a second time. Other electronic components may be mounted printed circuit board as well, including for example a microprocessor, discrete components, logic circuitry, or other kinds of devices or combinations of devices. A connector 313 connects printed circuit board 311 with other electronics elsewhere in dispensing device 200. In some embodiments, each drawer includes a microprocessor, which communicates with the controller of dispensing device 200 via a communication bus in a backplane of dispensing device 200.

Each of multi-colored light sources 312 aligns with one of light pipes 309, so that light emitted by one of the multi-colored light sources is directed upward through the corresponding light pipe 309 to be emitted from the top of the light pipe. Dispensing device 200 can use this mechanism to highlight a particular one of bins 306, to guide a user to a particular bin holding a particular item to be dispensed.

In some embodiments, multi-colored light sources 312 are light emitting diodes (LEDs), each of which is capable of emitting light of different colors at different times, depending on how the LED is driven. For example, separate red, green, and blue LED elements may be housed in a single package, and may be independently controllable. By energizing the elements separately, red, green, or blue light may be produced from a single device. A wide variety of other colors can be produced by energizing the red, green, and blue elements in combination and varying the proportions of current provided to the red, green, and blue elements. In other embodiments, each of light sources 312 may be an LED containing only two elements of different colors, or more than three elements.

In other embodiments one or more of light sources 312 may comprise multiple separate light source packages mounted in close proximity on printed circuit board 311. For example, red and green LEDs may be used and positioned closely together, so that each adjacent pair of red and green LEDs is considered a multi-colored light source. The red and green elements may be operated separately or together to produce different colors. Similarly, three or more separate LEDs could be mounted in close proximity to form a multi-colored light source 312. In other embodiments, a light source could comprise multiple LEDs or other devices of differing colors spaced from each other and used in a coordinated manner to act as a light source.

Figure 4:
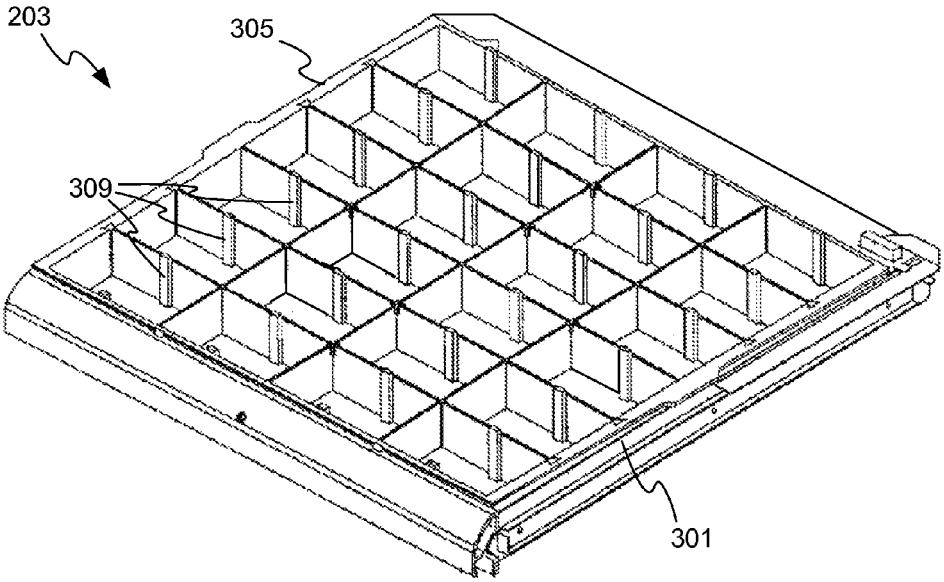
FIG. 4 illustrates the example drawer of FIG. 3 in its assembled state.

FIG. 4 illustrates example drawer 203 in its assembled state, in which liner 305 has been inserted into tray frame 301. Light pipes 309 remain visible to channel light from light sources 312.

Figure 5:
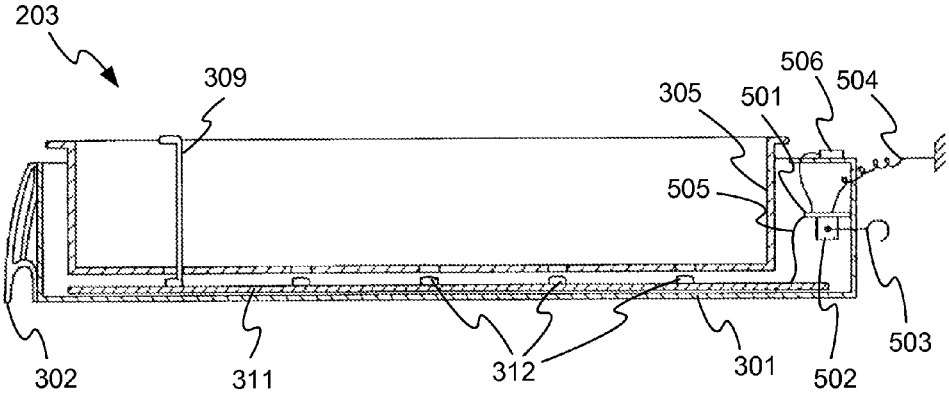
FIG. 5 illustrates a cutaway view of the example drawer of FIG. 3, showing additional features that may be included.

FIG. 5 illustrates a cutaway view of drawer 203, showing additional features that may be included. As shown in FIG. 5, drawer 203 may further include a second printed circuit board 501 in electrical communication with a solenoid 502 to move a latch 503. In turn, latch 503 is employed to lock drawer 203 to dispensing device 200. Electrical current is provided to second printed circuit board 501 through a line 504 from the backplane of the dispensing device, while power is supplied to printed circuit board 311 by a line 505.

Optionally, drawer 203 may include a sensor 506 which is employed to detect when drawer 203 is withdrawn from dispensing device 200. Sensor 506 is connected to printed circuit board 501. If a caregiver or other user of dispensing device 200 neglects to close drawer 203 after a transaction, sensor 506 can detect that the drawer is still open so that an alarm or reminder signal may be produced by dispensing device 200. An exemplary sensor will comprise an infrared source and receiver. With such a sensor, a vane will be employed to break the light path when the drawer opens. Other kinds of sensors may be used as well, for example a Hall Effect sensor sensing the proximity of a magnet.

Latch 503 will preferably unlock after appropriate information is entered into dispensing device 200 by the caregiver. Such information can include for example, caregiver or patient identification information (including passwords) and item identification information. After a specified time period, latch 503 may again lock so that if the caregiver neglects to open the drawer, the drawer will relock. Hence, the drawer will be able to relock itself after a "time out" period has elapsed to prevent further access.

Figure 6:
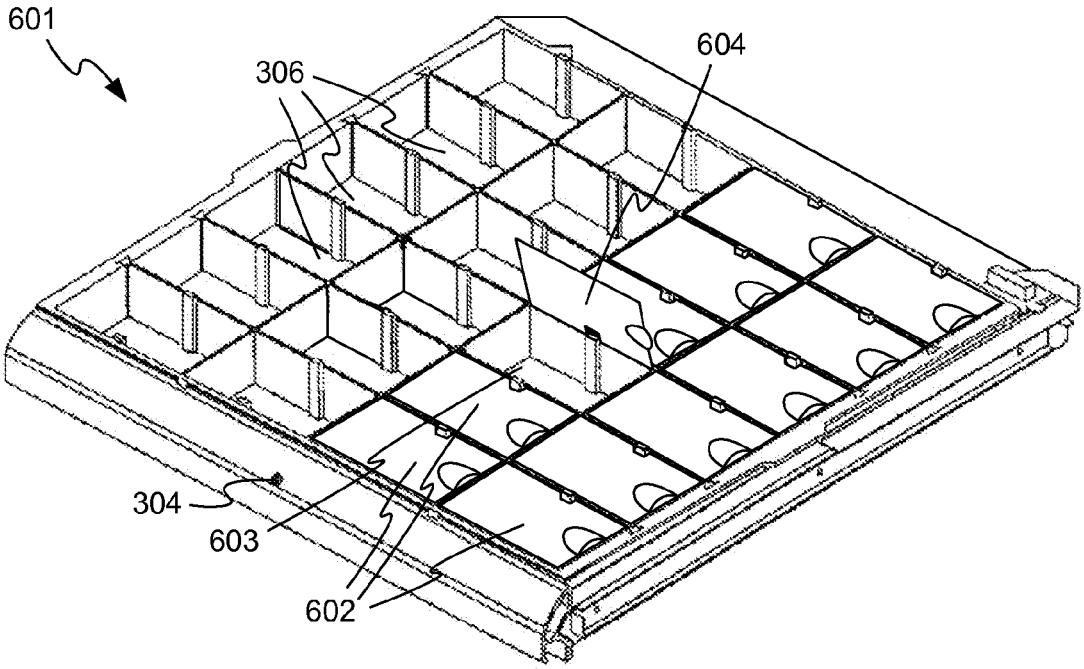
FIG. 6 illustrates drawer in accordance with other embodiments.

In some embodiments, some or all of bins 306 may also be individually closeable and lockable under control of the computerized controller of dispensing device 200. For example, FIG. 6 illustrates a drawer 601 of similar construction to drawer 203, in accordance with other embodiments. Similar elements are given the same references numerals in FIG. 6 as in the earlier figures. Drawer 601 further includes lids 602 on some of bins 306. In FIG. 6, one particular bin 603 is shown as being open, with its lid 604 in a raised position so that bin 603 is open. Each lid 602 may open and close using a rotational motion about an axle (not shown). In other embodiments, lids may open and close using a sliding or other motion.

In some embodiments, at least some of the lids are lockable under the control of the computerized controller of dispensing device 200. For example, a solenoid and latch mechanism similar to that described above may be used, or another kind of locking mechanism may be used. A sensor may also be provided for each lid 602, for sensing whether the lid is closed or open. For example, each lid may include vane (not shown) that interrupts an infrared light beam, or may include a magnet that is sensed by a Hall Effect sensor in the respective bin.

Thus, in the embodiment of FIG. 6, dispensing device 200 can lead a user to the correct drawer by illuminating the appropriate visual indicator 304, and may unlock only the correct drawer. In turn, dispensing device 200 may lead the user to the correct bin 306 within drawer 601 using one of the indicators within the drawer, and may unlock only the correct bin. With this level of access control, medication errors may be minimized and inventory tracking may be improved.

Other bins may have less stringent controls. For example, bins used for storing incidental supplies such as bandages, swabs, and the like may not be locked, although dispensing device 200 may still use the light sources to lead a user to the correct bin. Some supplies may be stored in bins or compartments that lack lids.

Figure 7A:
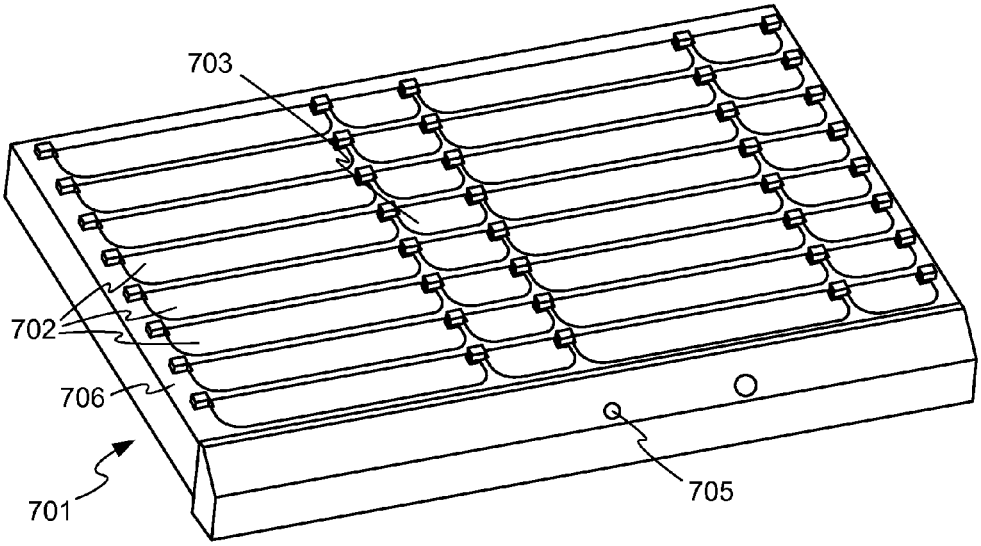
FIGS. 7A and 7B illustrate a drawer in accordance with other embodiments.
Figure 7B:
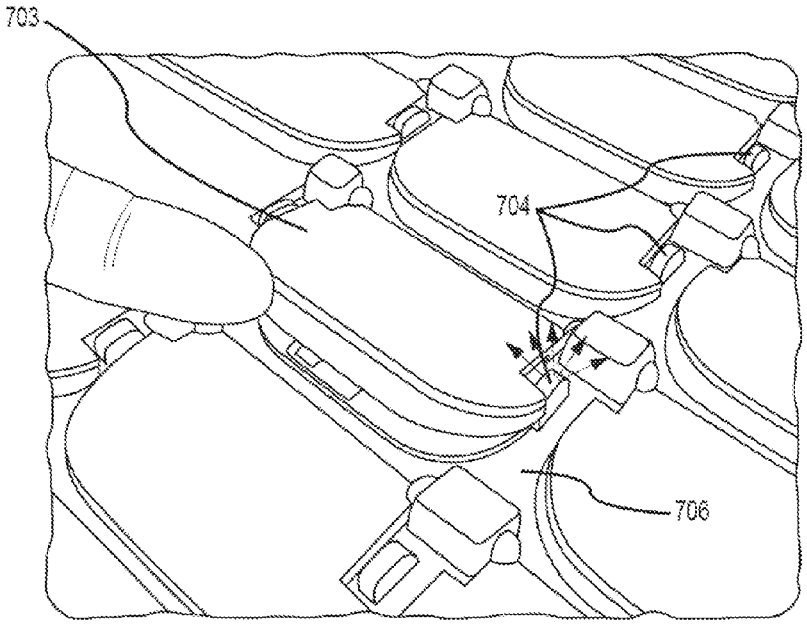

FIGS. 7A and 7B illustrate a drawer 701 in accordance with other embodiments. In drawer 701, lids 702 cover individual compartments. A respective LED is positioned near each of lids 702. For example, FIG. 7B shows a close-up view of a particular compartment 703 and its surrounding compartments. Compartment 703 is shown as partially open. Each of the compartments has an associated LED 704. The LED associated with compartment 703 is shown as illuminated, to guide the user to specific compartment 703. A visual indicator 705, for example another LED, may be used to guide a user to the correct drawer, and LEDs 704 may be used to guide the user to a correct bin. Any or all of LEDs 704 and visual indicator 705 may be multi-colored. Wiring or other circuitry for powering and selecting LEDs 704 and visual indicator 705 may be incorporated into drawer 701, for example beneath bezel or face 706.

Figure 8:
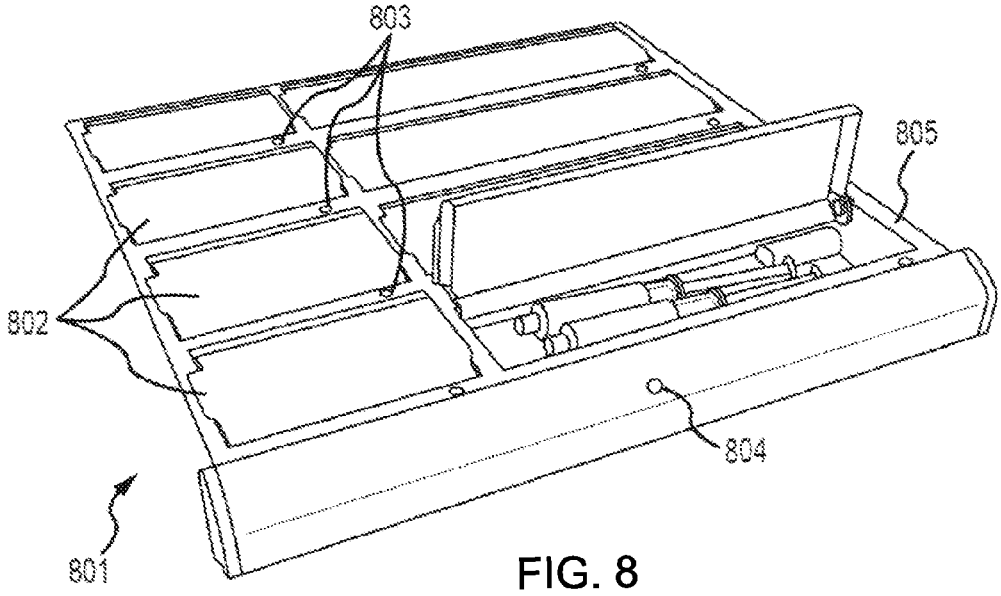
FIG. 8 illustrates a drawer in accordance with still other embodiments.

FIG. 8 illustrates a drawer 801 in accordance with still other embodiments. Drawer 801 also includes closeable compartments, covered by lids 802. Each compartment also has an associated LED 803, and drawer 801 includes a visual indicator 804. Any or all of LEDs 803 and visual indicator 804 may be multi-colored. Wiring or other circuitry for powering and selecting LEDs 803 and visual indicator 804 may be incorporated beneath bezel or face 805, or elsewhere in drawer 801.

Figure 9:
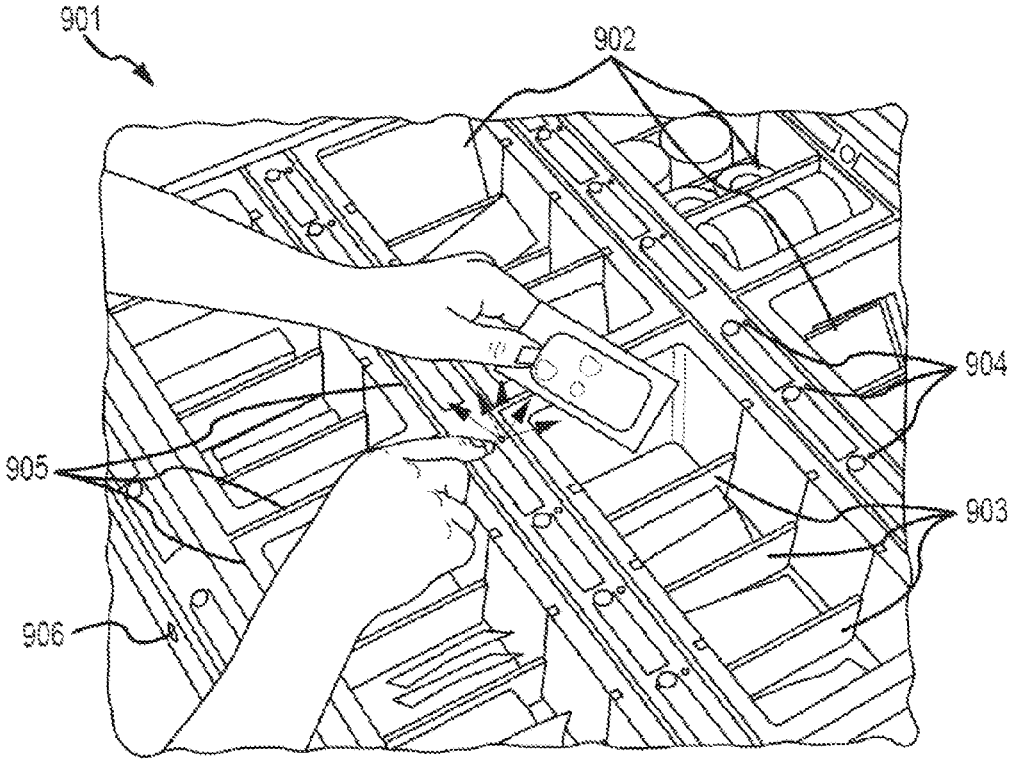
FIG. 9 illustrates a drawer in accordance with yet other embodiments.

FIG. 9 illustrates a drawer in accordance with yet other embodiments. Drawer 901 may be especially suited to storing supplies such as bandages, swabs and the like. Although such supplies may not be regulated, it may still be desirable that their use be tracked, for example for accounting and inventory purposes. Drawer 901 includes a plurality of bins 902 Each bin may be further subdivided into smaller compartments using movable dividers 903, but in this example embodiment, the bins do not include lids and are therefore not individually lockable. Each compartment has an associated light source 904, any or all of which may be multi-colored and may be LEDs. Light sources 904 may be used to guide a user to a correct compartment within drawer 901. wiring or other circuitry for powering and selecting LEDs 904 may be incorporated into drawer 901, for example in the structures 905 between bins 902. Drawer 901 may also include a visual indicator 906 such as a multi-colored LED or other light source for guiding a user to drawer 901 itself.

While embodiments of the invention are described in relation to dispensing cabinet 100, and portable dispensing device 200 and drawers 203, 601, 701, 801, and 901, it is to be understood that the invention is not so limited. Many other arrangements for providing monitored and controlled access and visual indications may be envisioned in accordance with embodiments of the invention.

The multi-colored nature of light sources 312 may be utilized in a variety of ways. In some embodiments, the color of light emitted by a multi-colored light source used to direct a user to a compartment storing a medicine or medical supply item may communicate information about the type of the particular medicine or medical supply item in the associated compartment. For example, the color of light may be selected based at least in part on the controlled substance schedule of a particular medicine in the associated compartment. In one possible scenario, a compartment storing a schedule II medicine could be indicated by emitting red light from the associated light source, a compartment storing a schedule III medicine could be indicated by emitting orange light from the associated light source, a compartment storing a schedule IV medicine could be indicated by emitting yellow light from the associated light source, a compartment storing a schedule V medicine could be indicated by emitting blue light from the associated light source, and a compartment storing a medical supply item or an unscheduled medication could be indicated by emitting green light from its associated light source. Many other color schemes are possible, and many other kinds of information may be communicated using the color of a particular light source.

In other embodiments, the color of light emitted by a multi-colored light source used to direct a user to a compartment storing a medicine may be selected based on a different classification of the medicine. For example, a compartment storing a narcotic could be indicated by emitting red light from the associated light source, a compartment storing an antidepressant could be indicated by emitting blue light from the associated light source, or any other suitable color scheme may be used.

In some embodiments, one or more multi-colored light sources may flash in particular patterns to communicate information to a user of the device. For example, visual indicator 304 may flash to indicate which drawer to open, to enhance the visibility of visual indicator 304. Similarly, one of multi-color light sources 312 may flash to enhance its visibility in leading a user to a particular bin 306.

Other kinds of information may be communicated as well. For example, flashing may be used to indicate a fault condition of the dispensing device. A particular flash pattern may carry a special meaning, possibly in conjunction with a particular color of the flashing light source. Merely by way of example, an alternating pattern of two short-duration flashes followed by two long-duration flashes could signal the user that the dispensing device has lost network connectivity.

Another flash pattern and/or color may instruct the user of the cabinet to call a help line for instructions about how to recover from a particular fault condition, or to request that a service technician be dispatched to the dispensing device. Examples of conditions that may prompt a service request include a drop in power supply voltage to a compartment, suspected cabling issues, and the like.

In some embodiments, when an item is to be dispensed from the dispensing device, the light source associated with the compartment holding the item may be illuminated in a first color, and light sources associated with other compartments may be illuminated in a different color. For example, if a dispensing request is made for an item in a particular drawer of dispensing device 200, then the visual indicator 304 of the particular drawer may be illuminated in green, and the visual indicators of the other drawers may be illuminated in red. Similarly, if a request is made to dispense an item in a particular bin 306 of a drawer such as drawer 203, then the light source associated with the particular bin 306 may be illuminated in green and the light sources associated with the other bins in the drawer may be illuminated in red. It will be recognized that any other workable color combination may be used.

In other embodiments, the multi-colored light sources may be used to communicate information about whether the user of the dispensing device is authorized to access certain items contained in the dispensing device. For example, if the user of dispensing device 200 requests an item that he or she is not authorized to dispense, then all of the visual indicators 304 of all of the drawers 203 may be flashed red, to indicate that access is denied. Of course, any other suitable color or pattern of illumination may be used.

In other embodiments, when the user of dispensing device 200 requests an item that he or she is not authorized to dispense, one or more of the light sources may be illuminated with a particular color and/or flash pattern that indicates the level of authorization required to dispense the requested item. For example, a requirement for the approval of a shift supervisor could be indicated by a yellow light, while a requirement for the approval of a pharmacist could be indicated by a red light. Any suitable combination of light color and flash pattern may be used.

In other embodiments, a dispensing device such as dispensing device 200 may detect the state of a compartment such as one of bins 306, and a light color and/or flash pattern may indicate the state of the particular compartment. For example, dispensing device 200 may be fitted with sensors that can detect whether the lid 602 of a bin 306 is fully closed. A light source associated with a particular bin could be illuminated or flashed or both to indicate that a bin is not fully closed, and therefore may be overfilled. In another example, the dispensing device may detect that a sensor or compartment is damaged, and may use a particular light color and/or flash pattern to communicate that information. For example, if a particular drawer or bin is indicated to be accessed, but it is not detected that the drawer or bin is opened, this may be an indication that the sensor on the drawer or bin has malfunctioned. Any suitable color and/or flash pattern may be used.

In another example, a flashing red light may be used to indicate that the user has opened an incorrect bin. This state may be detected, for example, when the dispensing device has indicated that a requested medication or supply item is in a particular bin (which may be closed but not locked), but then detects using sensors on the bin lids that the user opened a different bin. One or more of the light sources may be flashed red to signal the user that an error has occurred. Other color and/or flashing schemes may also be used.

In another example, the dispensing device may control one or more of the multi-colored light sources to indicate that one of the compartments has been the subject of a break-in attempt. For example, the dispensing device may detect using a sensor that a compartment has been opened, and may also recognize that the opened compartment should not have been accessed. The dispensing device may recognize that the compartment should not have been accessed by recognizing that the dispensing device did not unlock the compartment that was opened, or by some other method. The dispensing device may also communicate an indication of the break-in attempt to a central location so that the incident can be investigated further.

In other embodiments, the brightness of one or more of the light sources may be controllable by the computerized controller of the dispensing device. Brightness control may be accomplished, for example, by controlling the average current supplied the light sources. For an LED light source, brightness control may be conveniently accomplished by pulse width modulation of a circuit driving the LED. Preferably, the pulse width modulation is done at a sufficiently high frequency that during times when the LED is on, the human eye does not perceive any flicker or blinking Flashing of the LED is then accomplished by alternating "on" periods (each of which may include many short-duration current pulses) with "off" periods when no current is supplied.

The brightness level may be specified by the user of the dispensing device, or may be selected automatically by the dispensing device. For example, the user of the dispensing device may use a keyboard such as keyboard 104 or another user input device such as one of devices 202 to specify a preferred brightness for the various light sources on the dispensing device, and the computerized controller of the dispensing device may then control the brightness according to the user input. Once the brightness is specified, the dispensing device may continue to use the specified brightness setting until a new setting is input. Alternatively, the brightness setting may revert to a default value after a period of time, at the start of each new day, or upon some other event. In other embodiments, a hardware control may be provided, such as a knob or slider, that directly adjusts the brightness of the light sources.

In order to perform automatic brightness selection, the dispensing device may include a sensor that measures the brightness of the ambient environment in which the dispensing device is being used. The dispensing device may then select a brightness level based on the measured ambient environment. For example, in a very bright environment such as an operating room, a very high brightness of the light sources may be desirable to ensure that the light sources can be plainly seen. However, in a relatively dim environment such as a hospital ward at night, very bright light sources on the dispensing device may be distracting and unnecessary for visibility, and a lower brightness setting may be used.

Additional types of dispensing units in which the invention may be embodied or which include features usable with embodiments of the invention are described in the following commonly owned U.S. Patents and patent applications, the contents of which are hereby incorporated by reference: U.S. Pat. No. 6,272,394, issued on Aug. 7, 2001 to Lipps, U.S. Pat. No. 6,385,505, issued on May 7, 2002 to Lipps, U.S. Pat. No. 6,760,643, issued on Jul. 6, 2004 to Lipps, U.S. Pat. No. 5,805,455, issued on Sep. 8, 1998 to Lipps, U.S. Pat. No. 6,609,047, issued on Aug. 19, 2003 to Lipps, U.S. Pat. No. 5,805,456, issued on Sep. 8, 1998 to Higham et al, U.S. Pat. No. 5,745,366, issued on Apr. 28, 1998 to Higham et al., an U.S. Pat. No. 5,905,653, issued on May 18, 1999 to Higham et al., U.S. Pat. No. 5,927,540, issued on Jul. 27, 1999 to Godlewski, U.S. Pat. No. 6,039,467, issued on Mar. 21, 2000 to Holmes, U.S. Pat. No. 6,640,159, issued on Oct. 28, 2003 to Holmes et al., U.S. Pat. No. 6,151,536, issued on Nov. 21, 2000 to Arnold et al., U.S. Pat. No. 5,377,864, issued on Jan. 3, 1995 to Blechl et al., U.S. Pat. No. 5,190,185, issued on Mar. 2, 1993 to Blechl, U.S. Pat. No. 6,975,922, issued on Dec. 13, 2005 to Duncan et al., U.S. Pat. No. 7,571,024, issued on Aug. 4, 2009 to Duncan et al., U.S. Pat. No. 7,835,819, issued on Nov. 16, 2010 to Duncan et al., U.S. Pat. No. 6,011,999, issued on Jan. 4, 2000 to Holmes, U.S. Pat. No. 7,348,884, issued on Mar. 25, 2008 to Higham, U.S. Pat. No. 7,675,421, issued on Mar. 9, 2010 to Higham, U.S. Pat. No. 6,170,929, issued on Jan. 9, 2001 to Wilson et al., U.S. Pat. No. 8,126,590, issued on Feb. 28, 2012 to Vahlberg et al., U.S. Pat. No. 8,280,550, issued in Oct. 2, 2012 to Levy et al., and U.S. Patent Application Publication No. 2012/0203377 of Paydar et al., published on Aug. 9, 2012.

It is to be understood that all workable combinations of the features disclosed herein are also considered to be disclosed. For example, any of the visual indications described herein may be made using an appropriate combination of light source color and flashing pattern.

The invention has now been described in detail for purposes of clarity and understanding. However, it will be appreciated that certain changes and modifications may be practiced within the scope of the appended claims.

What is claimed is:

1. A device for dispensing items, comprising:

a plurality of compartments for storing medicines or medical supplies;

a respective light source associated with each of the plurality of compartments; and a computerized controller coupled to the light sources and capable of controlling the light sources, wherein the computerized controller maintains an inventory of the contents of the plurality of compartments and receives requests to dispense medicines or medical supplies from the plurality of compartments;

and wherein in response to a request to dispense a particular medicine or medical supply item, the computerized controller illuminates the light source associated with the compartment holding the particular medicine or medical supply item;

and wherein the light sources are multi-colored light sources configured to emit light of a first color at a first time and light of a second color at a second time, and wherein the color of light emitted by the multi-colored light sources is controlled by the computerized controller;

and wherein the computerized controller illuminates the multi-colored light source associated with the compartment holding the particular medicine or medical supply item such that the color of light emitted by the illuminated multi-colored light source conveys information about the type of the particular medicine or medical supply item in the associated compartment.

2. The device for dispensing items of claim 1, wherein the light source is illuminated with a brightness controlled by the computerized controller, and wherein the computerized controller selects the brightness of the light source in response to an input from a user of the device.

3. The device for dispensing items of claim 1, wherein the light source is illuminated with a brightness controlled by the computerized controller, the device further comprising a sensor that detects the brightness of the ambient environment, wherein the computerized controller automatically selects the brightness of the light source in response to the detected brightness of the ambient environment.

4. The device for dispensing items of claim 1, wherein the computerized controller causes at least one of the plurality of light sources to flash in order to communicate information to a user of the device.

5. The device for dispensing items of claim 1, wherein the computerized controller causes at least one of the plurality of light sources to be illuminated using a particular color and a particular flash pattern in order to communicate information to a user of the device.

6. A device for dispensing items, comprising:

a plurality of compartments for storing items;

a respective multi-colored light source associated with each of the plurality of compartments; and a computerized controller coupled to the multi-colored light sources, the computerized controller controlling one or more of the multi-colored light sources to emit light of a first color at a first time and light of a second color at a second time;

wherein the compartments store medicines or medical supplies;

and wherein the computerized controller maintains an inventory of the contents of the plurality of compartments and receives requests to dispense medicines or medical supplies from the plurality of compartments;

and wherein in response to a request to dispense a particular medicine or medical supply item, the computerized controller illuminates the multi-colored light source associated with the compartment holding the particular medicine or medical supply item such that the color of light emitted by the illuminated multi-colored light source conveys information about the type of the particular medicine or medical supply item in the associated compartment.

7. The device for dispensing items of claim 6, wherein the plurality of multi-colored light sources comprises one or more multi-colored light emitting diodes.

8. The device for dispensing items of claim 6, wherein one of the plurality of multi-colored light sources comprises:

a first light emitting diode that emits light of the first color; and a second light emitting diode that emits light of the second color, the first and second light emitting diodes being in separate packages.

9. The device for dispensing items of claim 6, wherein the color of light emitted by the illuminated multi-colored light source is selected based at least in part on the controlled substance schedule of a particular medicine in the associated compartment.

10. The device for dispensing items of claim 6, wherein the computerized controller causes one or more of the multi-colored light sources to flash in a particular pattern to communicate information to a user of the device.

11. The device for dispensing items of claim 10, wherein the particular pattern identifies a fault condition of the device.

12. The device for dispensing items of claim 10, wherein the combination of the color of light emitted by the flashing multi-colored light source and the particular pattern identifies a fault condition of the device.

13. The device for dispensing items of claim 6, wherein the computerized controller is configured to detect a state of each of the plurality of compartments, and wherein the computerized controller controls one or more of the multi-colored light sources to indicate the state of one or more of the compartments.

14. The device for dispensing items of claim 13, wherein the computerized controller controls one or more of the plurality of multi-colored light sources to indicate that one of the plurality of compartments is overfilled.

15. The device for dispensing items of claim 13, wherein the computerized controller controls one or more of the plurality of multi-colored light sources to indicate that one of the plurality of compartments has been the subject of a break-in attempt.

16. The device for dispensing items of claim 13, wherein the computerized controller controls one or more of the plurality of multi-colored light sources to indicate that one of the plurality of associated compartments has been opened in error.

17. The device for dispensing items of claim 6, wherein the brightness of the multi-colored light sources is adjustable under control of the computerized controller.

18. The device for dispensing items of claim 17, wherein the computerized controller adjusts the brightness of the multi-colored light sources in response to an input from a user of the device.

19. The device for dispensing items of claim 17, further comprising a sensor that detects the brightness of the ambient environment, and wherein the computerized controller automatically adjusts the brightness of the multi-colored light sources in response to the detected brightness of the ambient environment.

20. The device for dispensing items of claim 6, wherein:

the computerized controller maintains an inventory of the contents of the plurality of compartments and receives requests to dispense items from the plurality of compartments; and in response to a request to dispense a particular item, the computerized controller causes the multi-colored light source associated with the compartment holding the particular item to emit light of a first color, and causes the multi-colored light sources associated with other compartments to emit light of a second color different from the first color.

21. The device for dispensing items of claim 6, wherein:

the computerized controller maintains an inventory of the contents of the plurality of compartments and receives requests to dispense items from the plurality of compartments; and in response to a request to dispense a particular item, the computerized controller causes the multi-colored light source associated with the compartment holding the particular item to emit light of a color selected based upon whether a user of the device is authorized to access the particular item.

22. The device for dispensing items of claim 1, wherein the color of light emitted by the illuminated multi-colored light source is selected based at least in part on the controlled substance schedule of a particular medicine in the associated compartment.

23. A device for dispensing items, comprising:

a plurality of compartments for storing items;

a respective multi-colored light source associated with each of the plurality of compartments; and a computerized controller coupled to the multi-colored light sources, the computerized controller controlling one or more of the multi-colored light sources to emit light of a first color at a first time and light of a second color at a second time;

wherein the computerized controller is configured to detect a state of each of the plurality of compartments, and wherein the computerized controller controls one or more of the multi-colored light sources to indicate one or more states selected from the set of states consisting of one of the plurality of compartments is overfilled and one of the plurality of compartments has been the subject of a break-in attempt.

* * * * *